United States Patent [19]

Olon et al.

[11] Patent Number: 4,792,701

[45] Date of Patent: Dec. 20, 1988

[54] FAILURE COMPENSATION CIRCUIT WITH THERMAL COMPENSATION

[75] Inventors: Thomas E. Olon, Fairview; Francis J. Zelina, Lake City, both of Pa.

[73] Assignee: American Sterilizer Company, Erie, Pa.

[21] Appl. No.: 33,543

[22] Filed: Apr. 1, 1987

[51] Int. Cl.[4] ..... H05B 41/30

[52] U.S. Cl. ..... 307/11; 307/10 LS; 340/642; 340/81 R; 315/135; 315/130

[58] Field of Search ..... 307/9, 10 R, 10 BP, 307/10 LS, 11; 340/52 R, 52 D, 52 F, 88, 641, 642, 521; 324/83 D; 315/47, 50, 55, 57, 58, 64, 71, 74, 75, 76, 77, 80, 82, 83, 112, 113, 117, 120, 126, 127, 129, 123, 135, 88, 89, 130; 323/905

[56] References Cited

U.S. PATENT DOCUMENTS

| | | | |
|---|---|---|---|
| 3,363,143 | 1/1968 | Cavanaugh . | |
| 3,723,854 | 3/1973 | Kita . | |
| 3,898,516 | 8/1975 | Nakasone . | |
| 4,258,292 | 3/1981 | Kassfeldt | 340/81 R X |
| 4,295,079 | 10/1981 | Otsuka et al. | 340/642 X |
| 4,330,778 | 5/1982 | Yamazaki et al. | 340/642 |
| 4,392,087 | 7/1983 | Zansky . | |
| 4,396,868 | 8/1983 | Watanabe et al. | 340/642 X |
| 4,451,822 | 5/1984 | Verse et al. | 340/642 |

*Primary Examiner*—William M. Shoop, Jr.
*Assistant Examiner*—Paul Ip
*Attorney, Agent, or Firm*—Kirkpatrick & Lockhart

[57] ABSTRACT

A failure compensation circuit automatically reduces the output voltage of a power supply when a portion of a load drops out. The compensation circuit includes a circuit for generating a control signal representative of the desired voltage across the load. A power supply supplies voltage to the load in response to the control signal. An input signal representative of the current delivered to the load is produced which decreases whenever a portion of the load drops out. The circuit for generating the control signal is responsive to the input signal for adjusting the control signal such that when the current delivered to the load decreases, the voltage delivered to the load is automatically reduced.

16 Claims, 4 Drawing Sheets

V Ref.
V
Vf
t

V
Vcl
t

V
t
-V

V
Vc2
t

FAILURE COMPENSATION CIRCUIT WITH THERMAL COMPENSATION

BACKGROUND OF THE INVENTION

Field of the Invention

The present invention is directed to controllers and more particularly to compensation circuits which react to load changes.

There are a wide variety of controllers used to supply power to various types of loads. Controllers used to supply power to multiple lamps may include constant current or constant voltage types of controllers. Problems are encountered, however, when one lamp of a parallel connected group of lamps fails. The decrease in voltage drop across the line when a lamp fails increases the voltage across the remaining lamps. A constant voltage source, because it is incapable of recognizing that one of the lamps has failed, continues to supply the same voltage to the line plus the lamp load, resulting in a decreased voltage drop across the line resistance and an increased voltage across the lamp load. This may cause a premature failure of the remaining lamps.

A constant current source suffers from an even greater problem. When a lamp of a parallel connected group of lamps fails, the current drawn by the lamp group decreases. The constant current source, sensing a drop in current, increases its output voltage to maintain a constant current output. In that situation, the remaining lamps must dissipate the additional power resulting from the increase in the voltage output from the controller.

There is a need for a lamp controller capable of recognizing when one lamp of a parallel connected group of lamps fails. In response to that lamp's failure, the voltage output from the controller should be reduced so that the remaining lamps do not fail prematurely.

Another problem which prior art controllers suffer from is thermal drift. It is well known that the output of various electrical components drifts as the temperature of the component changes. The typical prior art solution is to provide an additional circuit element such as a thermistor which has a similar thermal drift but in the opposite direction. The problem with supplying thermistors is that the thermistor must be carefully matched to the thermal drift of the element for which compensation is required. Where there is a line of related products, it is often necessary to have a special thermistor for each product. This results in increased spare parts inventory as well as increased maintenance cost.

SUMMARY OF THE PRESENT INVENTION

The present invention is directed to a failure compensation circuit for automatically reducing the output voltage of a power supply when a portion of a load drops out. The compensation circuit comprises a circuit for generating a control signal representative of the desired voltage across the load. A power supply supplies voltage to the load in response to the control signal. An input signal is produced which is representative of the current delivered to the load. That current decreases in response to a portion of the load dropping out. The means for generating the control signal is responsive to the input signal for adjusting the control signal such that when the current decreases, the voltage delivered to the load is automatically reduced.

The present invention, when used with a group of parallel connected lamps, is capable of sensing the failure of one of the lamps. In response to that lamp's failure, the voltage is reduced such that the remaining lamps are not subjected to an overvoltage condition. This prevents premature failure of the remaining lamps.

The invention also contemplates the use of a constant current source having a known thermal drift. The amount of thermal drift is related to the value of the current produced by the constant current source. Thus, the constant current source can be manipulated so that the thermal drift of the constant current source matches the thermal drift of the elements in the circuit which require compensation. Because the amount of thermal drift for which compensation can be provided is adjustable by simply adjusting the amount of current produced by the constant current source, a single type of constant current source can be used to provide thermal compensation in a wide variety of products. This allows a single component to be used in multiple applications which reduces spare parts inventory and maintenance costs. These and other advantages and benefits of the present invention will become apparent from the following description of a preferred embodiment.

BRIEF DESCRIPTION OF THE DRAWINGS

In order that the present invention may be clearly understood and readily practiced, a preferred embodiment will now be described, by way of example only, with reference to the accompanying figures wherein.

DESCRIPTION OF A PREFERRED EMBODIMENT

I. Structural System Overview

Figure 1:
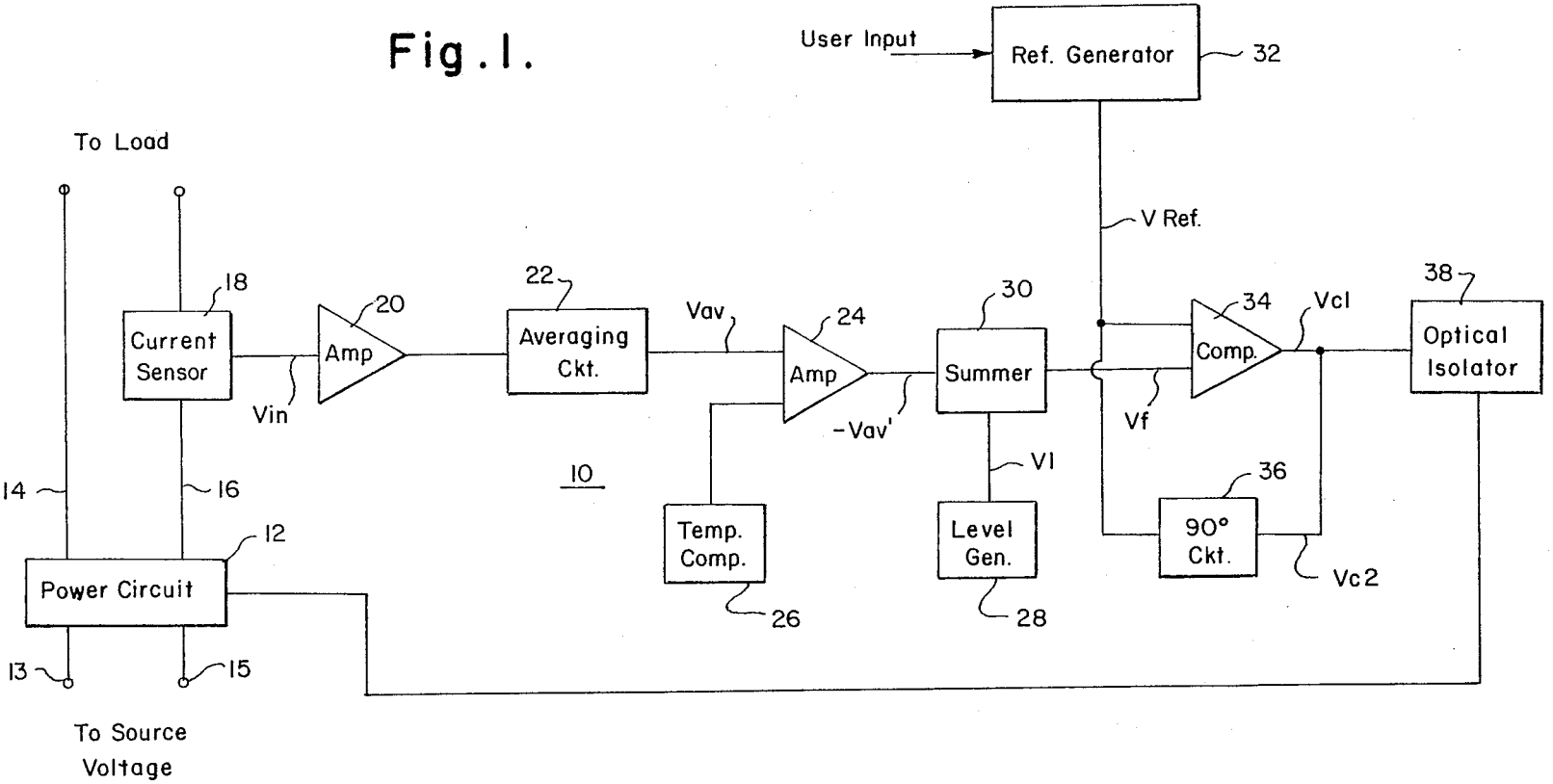
FIG. 1 is a block diagram illustrating a failure compensation circuit constructed according to the teachings of the present invention.

FIG. 1 illustrates a failure compensation circuit 10 constructed according to the teachings of the present invention. The failure compensation circuit will be described in the context of a controller for a parallel connected group of lamps. However, the reader should appreciate that the teachings of the present invention are equally applicable to other types of power sensitive loads.

In FIG. 1, a power circuit 12, connectable at input terminals 13 and 15 to a source voltage (not shown), delivers power to the load (not shown) through a pair of conductors 14 and 16. A current sensor 18 is responsive to the current flowing through conductor 16.

The current sensor 18 produces an input signal $V_{in}$ which is amplified by an amplifier 20 and input to an averaging circuit 22. The averaging circuit 22 produces an average value signal $V_{av}$ which is the average value of the input signal $V_{in}$.

The average value signal $V_{av}$ is input to an amplifier 24 which inverts the average value signal $V_{av}$. It is known that the average value signal $V_{av}$ drifts due to temperature variations of the various components, particularly the current sensor 18. For that reason, a temperature compensation circuit 26 is provided which produces a signal that compensates for the drift in the average value signal $V_{av}$. The signal produced by the temperature compensation circuit 26 is input to the amplifier 24 such that the amplifier 24 produces an inverted, temperature compensated, average value signal $-V_{av}'$.

A level generator 28 produces a level signal $V_1$ which is combined with the temperature compensated average value signal $-V_{av}'$ in a summer 30 to produce a firing level signal $V_f$.

A reference generator 32 produces a reference signal $V_{ref}$ which is representative of the desired voltage across the load. The reference generator 32 is responsive to user input such that the user can adjust the desired voltage across the load.

The firing level signal $V_f$ and the reference signal $V_{ref}$ are compared in a comparator 34. In response to that comparison, the comparator 34. In response to that comparison, the comparator 34 produces a first control signal $V_{cl}$ which is representative of the desired voltage across the load. The manner in which the first control signal $V_{cl}$ is produced, and the use of the first control signal, are discussed in more detail hereinbelow in the section entitled "FUNCTIONAL SYSTEM OVERVIEW".

It is possible under certain circumstances that the comparison by comparator 34 of the reference signal $V_{ref}$ and the firing level signal $V_f$ will not produce the first control signal $V_{cl}$. For that reason, a 90° circuit 36 is provided. The 90° circuit is responsive to the reference signal $V_{ref}$ and is constructed to guarantee the production of a second control signal $V_{c2}$. The second control signal insures that a certain minimal amount of power will be supplied to the load.

The power circuit 12 is responsive to both the first and second control signals through an optical isolator 38. The second control signal is always generated but is only used by the power circuit in the event that the first control signal is not generated.

II. Functional System Overview

Figure 2:
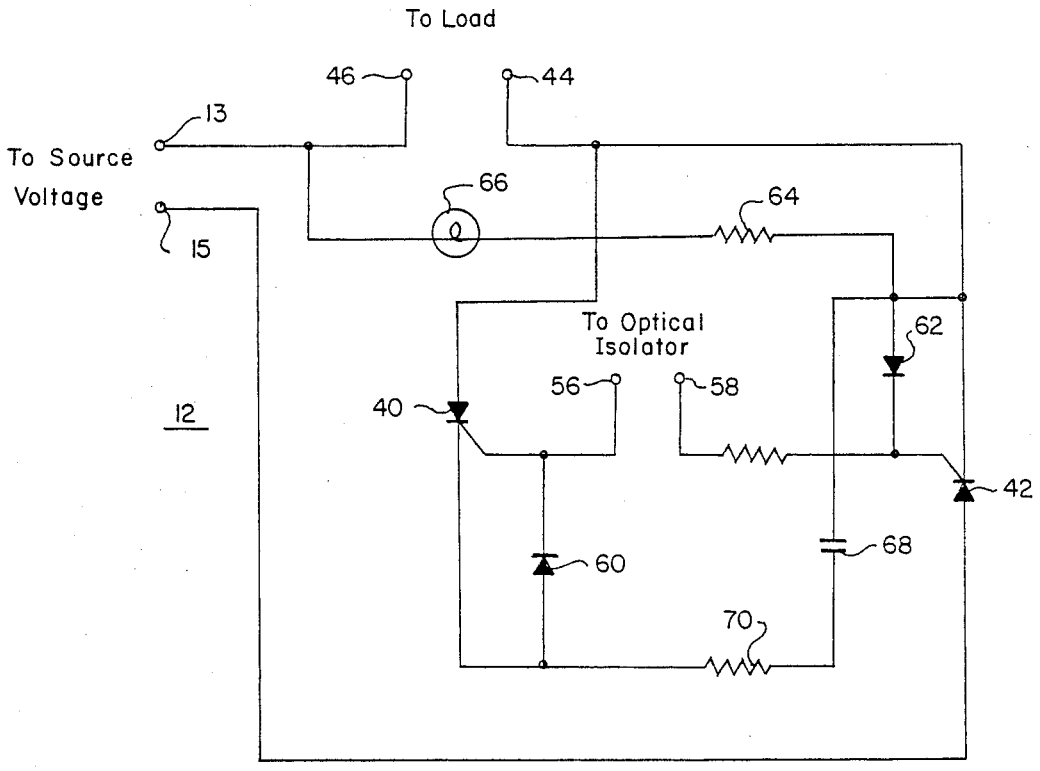
FIG. 2, is an electrical schematic illustrating the details of the power circuit shown in FIG. 1.

To understand how the failure compensation circuit 10 of the present invention functions, it is helpful to have some understanding of the construction and operation of the power circuit 12. FIG. 2 illustrates an electrical schematic of the power circuit 12 shown in FIG. 1. The power circuit 12 is a conventional circuit for phase controlling the firing of two back to back connected silicon controlled rectifiers 40 and 42.

The anode of the SCR 40 and the cathode of the SCR 42 are connected to an output terminal 44. The cathode of the SCR 40 and the anode of the SCR 42 are connected to the input terminal 15 which is connectable to a source voltage (not shown). The second input terminal 13 is connected to a second output terminal 46. The output terminals 44 and 46 are connectable to the conductors 14 and 16 for delivering power to the load.

A gate terminal of the SCR 40 is connected to a control input terminal 56 while a gate terminal of the SCR 42 is connected to a control input terminal 58. The control input terminals 56 and 58 are responsive, through the optical isolator 38, to the first and second control signals.

A diode 60 is connected between the control input terminal 56 and the input terminal 15. The gate terminal of the SCR 42 is connected to the cathode of the SCR 42 through a diode 62. The junction between the anode of the diode 62 and the cathode of the SCR 42 is connected to the input terminal 13 through the series connection of a resistor 64 and an indicator lamp 66. That junction is also connected to the input terminal 15 through the series combination of a capacitor 68 and a resistor 70.

The SCRs 40 and 42 operate in a conventional manner by conducting source voltage from terminals 13 and 15 to output terminals 44 and 46 depending upon the control signal input at their gate terminals. The operation of the power circuit 12 and the production of the first control signal $V_{cl}$ by comparator 34 may be more easily understood by reference to FIGS. 3A, 3B, and 3C.

Figures 3A, 3B, 3C, 3D:
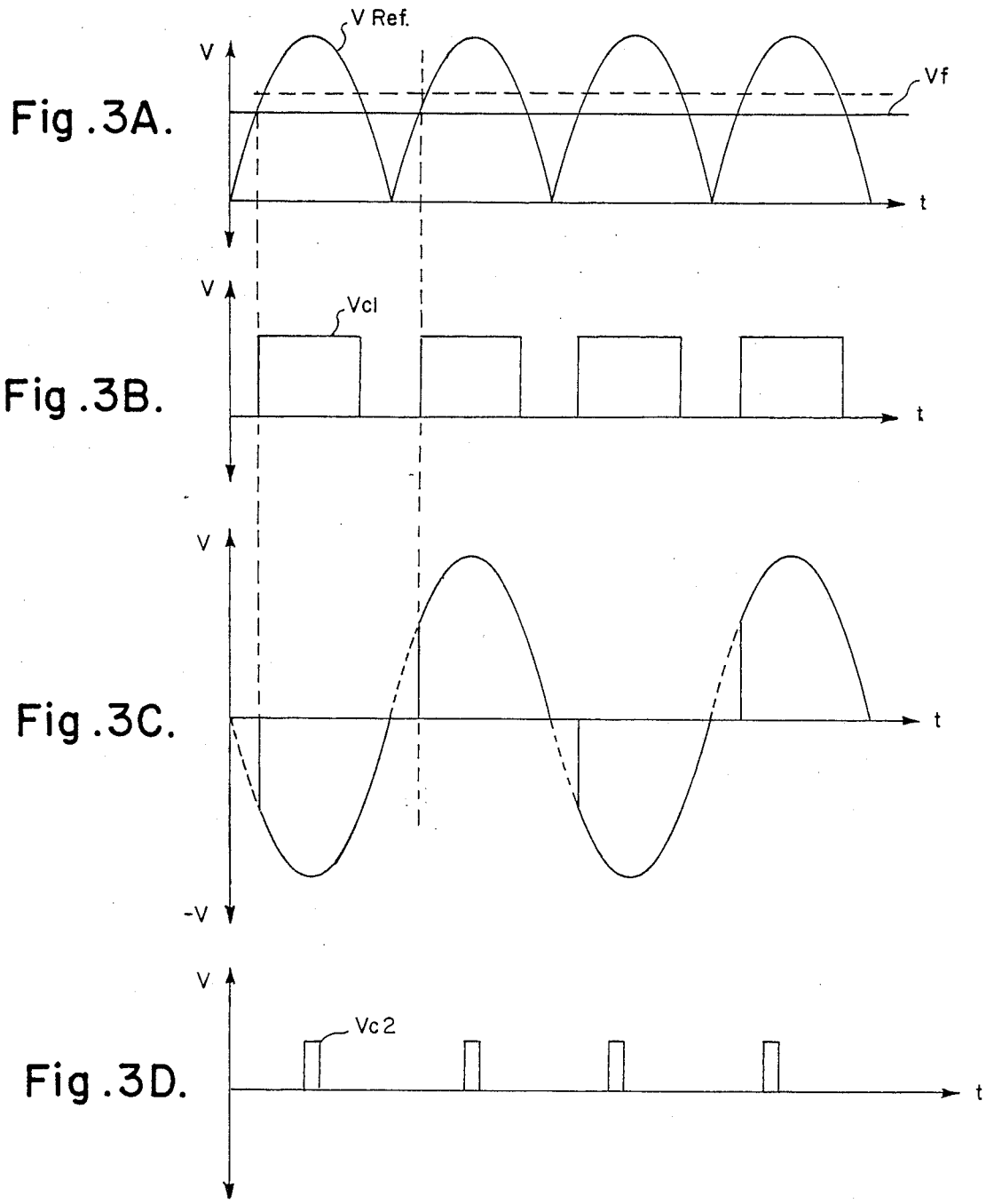
FIGS. 3A–3D illustrate various waveforms useful for understanding the operation of the present invention.

In FIG. 3A the reference signal $V_{ref}$ is illustrated. This signal $V_{ref}$ is in phase with the supply voltage available at input terminals 13 and 15. The supply voltage is shown in dotted lines in FIG. 3C. The reference signal $V_{ref}$ and the supply voltage available at terminals 13 and 15 may be produced, for example, by a multiple tap transformer.

The reference signal $V_{ref}$ is compared by comparator 34 to the firing level signal $V_f$. The firing level signal $V_f$ is itself comprised of two components, the level signal $V_1$ and the temperature compensated average signal $-V_{av}'$. Whenever the instantaneous value of the reference signal $V_{ref}$ equals the value of the firing level signal $V_f$, the first control signal $V_{cl}$ is produced as shown in FIG. 3B. The first control signal causes the SCR 40 or 42, whichever is properly biased, to become conductive and continue conducting power until the voltage waveform passes through zero as shown in FIG. 3C. Thus, the waveform shown in FIG. 3C is the voltage delivered to the load.

It will be apparent to the reader that because the reference signal $V_{ref}$ can be manipulated by the user, the voltage ultimately delivered to the load can be adjusted by the user. By increasing the magnitude of the reference signal $V_{ref}$, the reference signal more quickly equals the firing level signal $V_f$ such that more power is delivered to the load. By decreasing the value of the reference signal $V_{ref}$, it takes longer for the value of the reference signal $V_{ref}$ to equal the value of the firing level signal $V_f$ such that less power is delivered to the load. Those skilled in the art will recognize that this is a typical method of controlling the operation of silicone controlled rectifiers. By advancing or retarding the SCR conduction angle, load RMS voltage is controlled.

As previously stated, the voltage delivered to the load can be varied by the user by changing the magnitude of the reference signal $V_{ref}$. However, it should be apparent that the voltage delivered to the load can also be changed by changing the value of the firing level signal $V_f$. The firing level signal is comprised of two components, the first component being the level signal $V_1$ generated by the level generator 28. That component is fixed and does not change throughout the operation of the failure compensation circuit 10. The other component of the firing level signal $V_f$ is the temperature compensated average signal $-V_{av}'$. During normal operation, that signal changes only when the user changes the magnitude of the reference signal $V_{ref}$. When the user increases the value of the reference signal $V_{ref}$, that causes an increase in the current delivered to the load. The increased current increases the value of the input signal $V_{in}$. Because the reference generator 32 is calibrated to compensate for the new firing level signal $V_f$, increased power is delivered to the load. The converse occurs whenever the user decreases the value of the reference signal $V_{ref}$ in order to decrease the power delivered to the load.

The major function of the temperature compensated average signal $-V_{av}'$ is to automatically reduce the voltage output by the power circuit 12 whenever a load drops out such as when a lamp failure occurs. Whenever there is a lamp failure, the current delivered to the load decreases. That decrease is sensed by the current sensor such that the value of the average value signal $V_{av}$ is reduced. This reduced signal is inverted, temperature compensated, and combined in summer 30 with the fixed level signal $V_1$ such that the firing level signal $V_f$ increases. That increase is shown in FIG. 3A by the dotted line. Of course, with the firing level signal $V_f$ increased, it takes longer for the instantaneous value of the reference signal $V_{ref}$ to equal the value of the firing level signal $V_f$ such that less voltage is delivered to the load. In this manner, the failure of a lamp, or dropping out of a load, causes the fire level signal $V_f$ to increase such that less voltage is automatically delivered to the load. That reduced voltage prevents the remaining lamps from failing prematurely.

III. System Details

A. Current Sensor 18, Amplifier 20, Averaging Circuit 22

Figure 4:
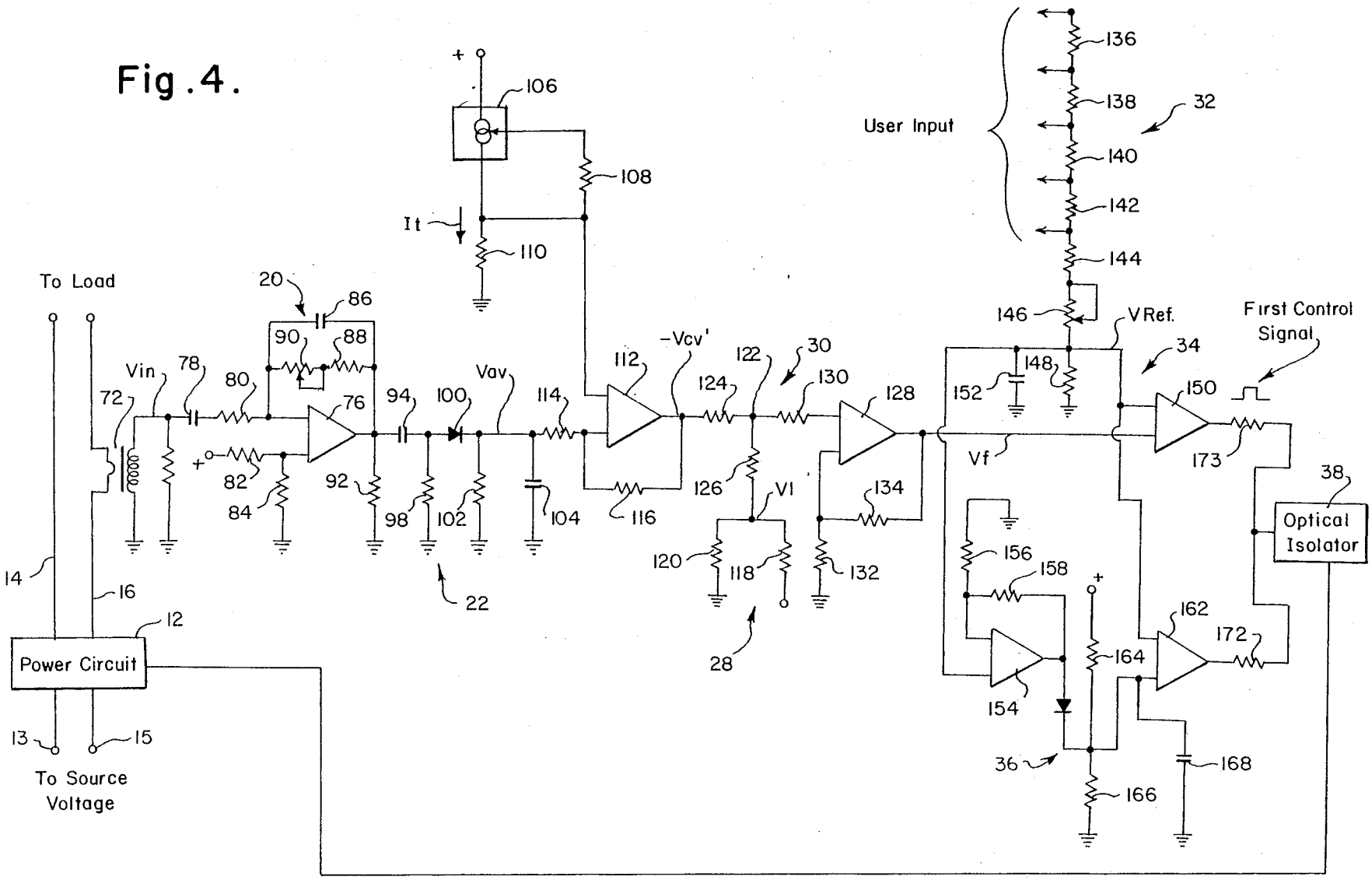
FIG. 4 is an electrical schematic illustrating the details of a failure compensation circuit constructed according to the teachings of the present invention.

The current sensor 18 illustrated in FIG. 1 may be comprised of a transformer 72 having a single turn primary winding as shown in FIG. 4. The transformer 72 is loaded with a resistor 74 connected to ground. The transformer 72 provides isolation and a means of sensing current without adding unwanted resistance.

The input signal Vin, produced by the transformer 72, is input to an inverting input terminal of an operational amplifier 76 through a coupling capacitor 78 and a resistor 80. The operational amplifier 76 has a noninverting input terminal connected to a positive voltage source through a resistor 82 and connected to ground through a resistor 84. An output terminal of the operational amplifier 76 is connected to the inverting input terminal thereof through a capacitor 86 connected in parallel with the series combination of a resistor 88 and a variable resistor 90. The output terminal of the operational amplifier 76 is also connected to ground through a resistor 92.

The amplified input signal $V_{in}$ is input to an input node 96 of the averaging circuit 22 through a coupling capacitor 94. The averaging circuit 22 is comprised of a resistor 98 connected between the input node 96 and ground, the series combination of a diode 100 and a resistor 102 connected between the input node 96 and ground, and a capacitor 104 connected between the junction of the diode 100 and resistor 102, and ground. The average signal $V_{av}$ is available across capacitor 104.

B. Temperature Compensator 26 And Amplifier 24

It is known that the average signal $V_{av}$ available at the output of the averaging circuit 22 varies with temperature such that the following relationship exists:

$$V_{av}=V_{dc}+(\Delta V_{av}/\Delta T) \quad (1)$$

where $V_{dc}$ is the DC component of the average signal $V_{av}$ and $\Delta V_{av}/\Delta T$ represents the change in the average signal with respect to time, i.e. the thermal drift.

To compensate for that thermal drift, a constant current source 106 is provided. The constant current source 106 has an input terminal connected to a positive voltage source and an output terminal connected to a control terminal through a resistor 108. The output terminal is also connected to ground through a resistor 110. The constant current source may be of a known type such as a LM134, LM234, or LM334.

The total current $I_t$ produced by the constant current source 106 is determined by the value of the resistor 108. The current $I_t$ produced by the constant current source 106 may be expressed as follows:

$$T_t=I_{set}+(\Delta I_{set}/\Delta T) \quad (2)$$

where $I_{set}$ is the current produced by the constant current source 106 and $(\Delta I_{set}/\Delta T)$ represents the change in the current over time, i.e. the thermal drift. For a known current source, the thermal drift is known. For example:

$$\Delta I_{set}/\Delta T=0.3\%\ I_{set}/^\circ C. \quad (3)$$

The thermal drift of the average signal $V_{av}$ can be measured. It is desirable to manipulate the current produced by the constant current source 106 such that the component of thermal drift of the current $I_{set}$ is equal to the thermal drift of the average signal $V_{av}$. Mathematically, $$(\Delta I_{set}/\Delta T)(R_{110})=\Delta V_{av}/\Delta T \quad (4)$$

Assuming $\Delta V_{av}/\Delta T$ is known from measurements to be 0.01 *V/°C., and substituting from equation (*3):

$$(0.003\ I_{set}/^\circ C.)(R_{110})=0.01\,V/^\circ C. \quad (5)$$

Assuming $R_{110}$ equals 10 kΩ, then $$I_{set}=0.333\ ma \quad (6)$$

From equation 6, the value of $I_{set}$ is determined. Knowing the value of the current $I_{set}$, the value for the resistor 108 can be chosen from the manufacturer's specifications to provide the desired current. In this manner, temperature compensation for a wide range of products can be provided by using standard components. This reduces parts inventory and simplifies field repairs.

The voltage produced across resistor 110 is input to a noninverting input terminal of an operational amplifier 112. The average signal $V_{av}$ is input to an inverting input terminal of the operational amplifier 112 through a resistor 114. The inverting input terminal of the operational amplifier 112 is connected to an output terminal thereof through a resistor 116. The operational amplifier 116 inverts the average signal $V_{av}$ and removes the thermal component therefrom thus producing the temperature compensated average signal $-V_{av}'$.

C. Level Generator 28 and Summer 30

The level generator 28 may be comprised of a pair of series connected resistors 118 and 120 connected between a positive source of voltage and ground. The resistors 118 and 120 are a voltage divider such that the level signal $V_1$ is available at the junction between the two resistors.

A summing node 122 is provided which receives the temperature compensated average signal $-V_{av}'$ through a resistor 124 and the level signal $V_1$ through a resistor 126. The combination of the two signals $-V_{av}'$ and $V_1$ produces the firing level signal $V_f$. The firing level signal $V_f$ is input to a noninverting input terminal of an operational amplifier 128 through a resistor 130. An inverting input terminal of the operational amplifier 128 is connected to ground through a resistor 132 and to an output terminal thereof through a resistor 134. The operational amplifier 128 may be used to buffer and amplify the firing level signal $V_f$ as needed. Thus, the firing level signal $V_f$ is available at the output terminal of the operational amplifier 128.

D. Reference Generator 32 Comparator 34 And 90° Circuit 36

The reference generator 32 is comprised of a string of series connected resistors. Resistors 136, 138, 140, 142, 144, adjustable resistor 146, and resistor 148 are connected in series between a positive source of voltage (not shown) and ground. The resistors are responsive to user input such that they may be switched into or out of the string of resistors. Clearly, by removing resistors from the resistive string the reference signal $V_{ref}$ is increased and by adding resistors to the resistive string the reference signal $V_{ref}$ is decreased.

The junction between the resistors 146 and 148 is connected to a noninverting input terminal of an operational amplifier 150. An inverting input terminal of the operational amplifier 150 receives the firing level signal $V_f$. The first control signal $V_{c1}$ is available at an output terminal of the operational amplifier 150. The operational amplifier 150 performs the function of the comparator 34 shown in FIG. 1. The first control signal $V_{c1}$ available at the output terminal of the operational amplifier 150 assumes a high state whenever the instantaneous value of the reference signal $V_{ref}$ equals the value of the firing level signal $V_f$ as described above in conjunction with the power circuit 12.

A capacitor 152 is connected across the junction between resistors 146 and 148 and ground. The junction between the resistors 146 and 148 is also connected to a noninverting input terminal of an operational amplifier 154. An inverting input terminal of the operational amplifier 154 is connected to ground through a resistor 156 and to an output terminal thereof through a resistor 158. The output terminal of the operational amplifier 154 is connected through a diode 160 to an inverting input terminal of an operational amplifier 162. The inverting input terminal of the operational amplifier is connected to a positive voltage source through a resistor 164, to ground through a resistor 166, and to ground through a capacitor 168.

In operation, the capacitor 168 charges to the peak value of the reference signal $V_{ref}$ minus 0.2V ($V_{ref}' = -V_{ref} - 0.2V$). That value $V_{ref}'$ is used as a second firing level signal by comparing it to the instantaneous value of the reference signal $V_{ref}$ which is input to a noninverting input terminal of the operational amplifier 162. As seen in FIG. 3D, the second control signal $V_{c2}$, which is available at the output terminal of the operational amplifier 162, assumes a high state whenever the instantaneous value of the reference signal $V_{ref}$ equals the value of the signal $V_{ref}'$.

Under normal operating conditions, by the time the second control signal $V_{c2}$ assumes a high state, the first control signal $V_{c1}$ will have assumed a high state such that one of the SCRs 40 or 42 will be conductive. Under those circumstances, the second control signal is not needed. However, under extraordinary circumstances it is possible that the instantaneous value of the reference signal $V_{ref}$ never equals the value of the firing level signal $V_f$ such that the first control signal is not produced. When that occurs, the power circuit 12 then becomes responsive to the second control signal. The second control signal assures that once each cycle, each SCR 40 and 42 will fire. That results in a conduction of a minimum amount of power to the load and prevents the power circuit 12 from becoming unstable and operating in a half-wave mode. Because the second control signal is always produced whenever the reference signal $V_{ref}$ has a phase angle of substantially 90 degrees, the components producing the second control signal are referred to as a 90° circuit.

The second control signal is input to the optical isolator 38 through a resistor 172 and OR'ed to the first control signal, which is input to the optical isolator through a resistor 173. The optical isolator 38 may be any commercially available known type of isolator.

IV. Conclusion

The present invention is directed to a controller used for supplying voltage to voltage sensitive loads. Unlike conventional controllers, whenever a load drops out, the voltage supplied to the remaining loads is decreased rather than increased to protect the remaining loads from having to dissipate too much power. The present invention achieves that result by providing circuitry which is responsive to the average value of a signal representative of the current delivered to the load. The present invention also provides temperature compensation for various components within the failure compensation circuit. This temperature compensation is provided by using the known thermal drift of the components of the failure compensation circuit. Thus, a single off the shelf component can be used to replace a wide variety of fixed thermistors.

While the present invention has been described in connection with an exemplary embodiment thereof, it will be understood that many modifications and variations will be readily apparent to those of ordinary skill in the art. This disclosure and the following claims are intended to cover all such modifications and variations.

What we claim is:

1. A failure compensation circuit for automatically reducing the output voltage of a power supply when one or more lamps fail, said compensation circuit comprising:

means for generating a control signal representative of the voltage to be supplied to the lamps;

power supply means for supplying voltage to the lamps in response to said control signal; and means for producing an input signal representative of the current delivered to the lamps, said current decreasing in response to each lamp failure;

said means for generating a control signal being responsive to said input signal for adjusting said control signal such that when said current decreases said voltage supplied to the lamps is automatically reduced.

2. A failure compensation circuit for automatically reducing the output voltage of a power supply when one or more lamps fail, said compensation circuit comprising:

power supply means for supplying voltage to the lamps in response to a control signal;

means for producing an input signal representative of the current delivered to the lamps, said current decreasing in response to each lamp failure.

means for generating a reference signal representative of the desired lamp intensity;

means for combining said input signal and said level signal means for combining said input signal and said level signal to produce a firing level signal;

means for comparing said firing level signal to said reference signal for producing said control signal such that when said current decreases said firing level signal increases thereby automatically reducing the voltage delivered to the lamps.

3. The failure compensation circuit of claim 2 additionally comprising means for generating a second control signal representative of a minimum voltage across the lamps, said power supply means being responsive to one of said first and second control signals.

4. The failure compensation circuit of claim 3 wherein said means for generating a second control signal includes means responsive to said reference signal for producing a second firing level signal and including means for comparing said second firing level signal to said reference signal for producing said second control signal in response to said comparison.

5. The failure compensation circuit of claim 1 wherein the current delivered to the lamps is alternating current, and wherein said means for producing an input signal includes a current transformer responsive to the current delivered to the lamps and an averaging circuit responsive to said current transformer.

6. The failure compensation circuit of claim 5 wherein said averaging circuit produces an average value over approximately five cycles.

7. The failure compensation circuit of claim 1 wherein said means for producing an input signal has a known thermal drift, said failure compensation circuit additionally comprising a constant current source having a known thermal drift, and an amplifier responsive to said input signal and said constant current source such that said thermal drift of said constant current source compensates for said thermal drift of said means for producing an input signal.

8. A failure compensation circuit for automatically reducing the output voltage of a power supply when a portion of a load drops out, said compensation circuit comprising:

means for generating an AC reference signal representative of the desired AC voltage across the load;

means for generating a first DC firing level signal;

means for comparing said first firing level signal to the instantaneous value of said reference signal for producing a first control signal in response to said comparison;

power supply means for supplying AC voltage to the load in response to said first control signal;

means for producing a DC input signal representative of the current delivered to the load, said current decreasing in response to a portion of the load dropping out; and means for adjusting said first firing level signal in response to said input signal such that when said load current decreases the voltage delivered by said power supply means is automatically reduced.

9. A failure compensation circuit for automatically reducing the output voltage of a power supply when a portion of a load drops out, said compensation circuit comprising:

means for generating an AC reference signal representative of the desired AC voltage across the load;

means for generating a first DC firing level signal;

means for comparing said first firing level signal to the instantaneous value of said reference signal for producing a first control signal in response to said comparison;

means for generating a second control signal representative of a minimum voltage across the load;

power supply means for supplying AC voltage to the load in response to one of said first and second control signals;

means for producing a DC input signal representative of the current delivered to the load, said current decreasing in response to a portion of the load dropping out; and means for adjusting said first firing level signal in response to said input signal such that when said load current decreases the voltage delivered by said power supply means is automatically reduced.

10. The failure compensation circuit of claim 9 wherein said means for generating a second control signal includes means responsive to said rectified AC reference signal for producing a second DC firing level signal and including means for comparing said second firing level signal to the instantaneous value of said reference signal for producing said second control signal in response to said comparison.

11. The failure compensation circuit of claim 10 wherein said second control signal is produced substantially when said rectified AC reference signal reaches its peak value.

12. The failure compensation circuit of claim 8 wherein said means for producing a DC input signal includes a current transformer responsive to the current delivered to the load and an averaging circuit responsive to said current transformer.

13. The failure compensation circuit of claim 8 wherein said means for producing a DC input signal has a known thermal drift, said failure compensation circuit additionally comprising a constant current source having a known thermal drift, and an amplifier responsive to said input signal and said constant current source such that said thermal drift of said constant current source compensates for said thermal drift of said means for producing an input signal.

14. The failure compensation circuit of claim 8 wherein said means for adjusting includes means for increasing the value of said firing level signal in response to the decrease in said input signal such that the voltage delivered by said power supply means is automatically reduced.

15. The failure compensation circuit of claim 8 wherein said power supply means includes a pair of silicon controlled rectifiers connected for supplying AC voltage to the load in response to said first control signal.

16. The failure compensation circuit of claim 15 additionally comprising an optical isolator between said means for producing a first control signal and said pair of silicon controlled rectifiers.

* * * * *

UNITED STATES PATENT AND TRADEMARK OFFICE

CERTIFICATE OF CORRECTION

PATENT NO. : 4,792,701

DATED : December 20, 1988

INVENTOR(S) : Thomas E. Olon et al.

It is certified that error appears in the above-identified patent and that said Letters Patent is hereby corrected as shown below:

Col. 8, line 31, after "of" insert --a constant current source to cancel out the known thermal drift of--.

Col. 8, line 66, after "failure" cancel "." and substitute therefor --,--.

Col. 9, line 1, cancel "means for combining said input signal and said level signal" and substitute therefor --means for generating a level signal;--.

Col. 9, line 32, cancel "1" and substitute therefor --2--.

Col. 10, line 25, cancel "rectified".

Col. 10, line 33, cancel "rectified".

Col. 10, line 35, cancel "8" and substitute therefor --9--.

Col. 10, line 40, cancel "8" and substitute therefor --9--.

Col. 10, line 49, cancel "8" and substitute therefor --9--.

UNITED STATES PATENT AND TRADEMARK OFFICE

CERTIFICATE OF CORRECTION

PATENT NO. : 4,792,701

DATED : December 20, 1988

INVENTOR(S) : Thomas E. Olon et al.

It is certified that error appears in the above-identified patent and that said Letters Patent is hereby corrected as shown below:

Col. 10, line 55, cancel "8" and substitute therefor --9--.

Signed and Sealed this

Fourth Day of September, 1990

*Attest:*

HARRY F. MANBECK, JR.

*Attesting Officer*

*Commissioner of Patents and Trademarks*